United States Patent [19]

Hurley

[11] 3,977,510

[45] Aug. 31, 1976

[54] AUTOMATIC FUNCTION MECHANISM FOR TYPEWRITERS

[75] Inventor: Edwin J. Hurley, Cortland, N.Y.

[73] Assignee: SCM Corporation, New York, N.Y.

[22] Filed: June 23, 1975

[21] Appl. No.: 589,726

[52] U.S. Cl. ..... 197/91; 197/83; 197/151; 197/181

[51] Int. Cl.[2] ..... B41J 19/62; B41J 33/02

[58] Field of Search ..... 197/82, 83, 91, 151, 197/168, 169, 181, 107, 6.7; 242/55, 57

[56] References Cited

UNITED STATES PATENTS

| | | | |
|---|---|---|---|
| 1,475,619 | 11/1923 | Barney | 197/51 |
| 1,608,279 | 11/1926 | Handley | 197/51 |
| 3,194,379 | 7/1965 | Szeluga | 197/151 |
| 3,204,746 | 9/1965 | Wolowitz | 197/181 X |
| 3,346,090 | 10/1967 | Goff et al. | 197/158 |
| 3,632,052 | 1/1972 | Read | 197/160 X |
| 3,637,060 | 1/1972 | McMahon | 197/6.7 |
| 3,643,778 | 2/1972 | Anderson | 197/151 |
| 3,729,081 | 4/1973 | Ozimek et al. | 197/181 X |
| 3,804,227 | 4/1974 | Cappotto et al. | 197/151 |
| 3,882,990 | 5/1975 | Genesio | 197/181 |
| 3,927,746 | 12/1975 | Wolowitz | 197/151 |
| 3,927,747 | 12/1975 | Wolowitz | 197/151 |
| 3,927,748 | 12/1975 | Wolowitz | 197/181 |
| 3,927,749 | 12/1975 | Wolowitz | 197/181 |

*Primary Examiner*—Edgar S. Burr
*Assistant Examiner*—Paul T. Sewell
*Attorney, Agent, or Firm*—Stanley J. Klem; Milton M. Wolson

[57] ABSTRACT

A method and mechanism for automatically performing typewriter functions such as backspacing and disabling the escapement mechanism of a typewriter. A ribbon cartridge carrying actuating abutments is inserted into the typewriter whereupon the abutments engage a mechanism to actuate a selected function as for example the backspace mechanism and also engage another mechanism to disable the escapement mechanism. Particularly adaptable to correcting typing errors, the present invention will minimize the manipulations now necessary to perform an error correcting operation. Having typed an erroneous character, the operator simply inserts a ribbon cartridge containing the actuating abutments. One of the abutments contacts an actuating mechanism within the typewriter to backspace the carriage. The second abutment contacts a second actuating mechanism within the typewriter to disable the escapement mechanism to prevent carriage movement during error correction or until the ribbon cartridge is removed. Other selected typewriter functions can also be actuated by cartridge insertion.

37 Claims, 7 Drawing Figures

AUTOMATIC FUNCTION MECHANISM FOR TYPEWRITERS

BACKGROUND OF THE INVENTION

The present invention relates to mechanisms for typewriters that utilize printing ribbon cartridges in general and include those of the type disclosed in U.S. Pat. No. 3,643,777 entitled TYPEWRITER RIBBON CARTRIDGE granted Feb. 22, 1972 and U.S. Pat. application Ser. No. 150,946 filed June 9, 1971 with Carl Anderson et al as inventors and entitled TYPEWRITER RIBBON CARTRIDGE, both of which are assigned to the assignee of the instant application. The term "cartridge" as used hereinafter is defined to include any form of ribbon holder or container irrespective of configuration and the manner of insertion into the typewriter.

More particularly, the present invention relates to typewriters and to the automatic actuation of typewriter functions upon insertion of the ribbon cartridge.

The term "typewriter function" is defined to include any typewriter operation which provides for the alignment of a selected platen impact point relative to the typewriter print point.

One particularly useful typewriter function that may be accomplished by the actuating mechanism of this invention is to provide an automatic backspace operation upon insertion of a cartridge. A typical backspace operation that may be automated by the actuating mechanism of this invention is fully disclosed in U.S. Pat. No. 3,482,671 entitled BACKSPACE MECHANISM FOR TYPEWRITERS granted on Dec. 9, 1969 with Richard Shattuck as inventor and assigned to the same assignee as the instant application. When cooperating with a modified cartridge, housing an error correction tape therein, several manipulative steps previously necessary for an error correction operation are directly eliminated.

Correcting typing errors have required a series of sequential manual operations of the typewriter. For example, when an operator typed an erroneous character, it was first necessary to depress the backspace key to actuate the backspace mechanism thereby repositioning the typewriter carriage to the proper printing station for making the correction. The typist would then manually position a section of correction tape over the printing station and overstrike the erroneously typed character to cover the error with correction material. Another backspace operation would then be necessary to again reposition the typewriter carriage to the proper printing station so that the correct letter may be typed over the correction material. Therefore, a series of manipulative operations by the operator are necessary to correct each erroneously typed character. The end result of the foregoing is that the typing speed is significantly reduced relative to the amount of erroneous characters typed, thereby significantly increasing the time and the cost required for the preparation of typed material.

Furthermore, the operator would inherently waste substantial amounts of correction ribbon. This is inherent in that it is necessary to hold the correction ribbon or strip with the fingers to properly position and continuously hold the correction ribbon at the printing station until the erroneously typed character is restruck and correction material deposited to the writing paper. The remaining portion of correction ribbon could be unsuitable for further use, due to the correction material being rubbed from the surface of the ribbon by contact with the fingers. Consequently, a greater segment of correction ribbon might be required to correct one erroneously typed character.

The present invention as applied to error correction, overcomes the foregoing disadvantages by providing in a typewriter an automatic backspacing operation and an automatic escapement disabling operation upon insertion of a ribbon cartridge. Disabling the escapement mechanism is advantageous in that no carriage movement takes place during an error correction operation. Therefore, only one backspace operation is necessary to correct an error, and that backspace operation is automated with the present invention. With the wide distribution and use of photo copying machines, it has been customary to make only a ribbon copy and thereafter reproduce additional copies. Thus, there is no necessity to correct multiple carbon copies. The invention is clearly not intended to apply only to the foregoing, but may readily be applied in conjunction with any related typewriter function.

Other advantages of the present invention will become more fully apparent from the following description.

SUMMARY OF THE INVENTION

The basic overall inventive concept disclosed contemplates the method and means for the automatic actuation of one or more selected typewriter functions upon cartridge insertion. Direct application of this concept to a typewriter function, as for example, an automatic backspacing and escapement disabling mechanism is illustrated in cooperation with a typewriter ribbon cartridge containing an error correction ribbon and is provided with means to actuate these mechanisms, such as abutments. The abutments are disposed on and project from the opposite walls of the ribbon cartridge and engage the typewriter automatic backspacing and escapement disabling mechanism upon insertion of the ribbon cartridge into the typewriter. A ribbon cartridge platform fixed within the typewriter provides support for the ribbon cartridge. On opposite upstanding walls of the ribbon cartridge support are actuating mechanisms pivotally supported thereon and individually coupled to a typewriter backspace mechanism and an escapement mechanism. The actuating levers are in the path of the correction ribbon cartridge abutments when the correction ribbon cartridge is inserted into the typewriter.

When an erroneous character is printed, the printing ribbon cartridge containing an inked ribbon is removed. The error correction ribbon cartridge is then inserted into the typewriter. As the correction ribbon cartridge is inserted, an abutment on the correction ribbon cartridge abuts a lever of the platform supported actuating mechanism. The actuating lever is urged to pivot counterclockwise and, through linkage, actuates the backspace mechanism to reposition the typewriter carriage to the proper printing station for correction of the erroneously typed character. A second abutment on the correction ribbon cartridge abuts a second lever of a second platform supported actuating mechanism. The second actuating lever is urged to pivot counterclockwise and, through linkage, disables the typewriter escapement mechanism thereby preventing further carriage movement until the ribbon cartridge is removed from the typewriter. The erroneously typed character is then re-struck through the correction ribbon to cover the previously struck character with correction material. Since the escapement mechanism has been disabled, no carriage movement occurs and the carriage therefore remains at the proper printing station. The correction ribbon cartridge is then removed from the typewriter. As the correction ribbon cartridge is removed from the typewriter, the escapement mechanism, which has been held disabled, is again operational. The printing ribbon cartridge without actuating means is then reinserted and the correct character is typed over the correction material.

Accordingly, it is an object of the present invention to provide a method and means for automatically actuating one or more selected typewriter functions upon the insertion of a cartridge.

It is another object of the present invention to provide a mechanism that automates the backspacing operation of a typewriter.

A further object of the present invention is to provide a mechanism that automatically disables the typewriter escapement mechanism upon insertion of a cartridge.

A further object of the present invention is methods and means to automatically and precisely reposition the carriage of a typewriter for typing over a previously typed character without manual manipulation.

Other objects, features, and advantages of the invention will become more apparent from the following description, including appended claims, and accompanying drawing.

BRIEF DESCRIPTION OF THE DRAWING

FIG. 5 is an enlarged perspective view of a portion of the error correction ribbon cartridge showing the ribbon cartridge approaching the backspace actuating mechanism.

DESCRIPTION OF THE PREFERRED EMBODIMENT

Although the inventive concept may be illustrated in conjunction with a variety of typewriter functions, such as carriage return and shift, the following embodiment has, for the purpose of clarity and ease of description, been confined to a common and readily employed function, namely, backspacing and error correction. The principle of this invention can be readily applied to other typewriter functions utilizing the embodiments described herein as examples.

Figure 1:
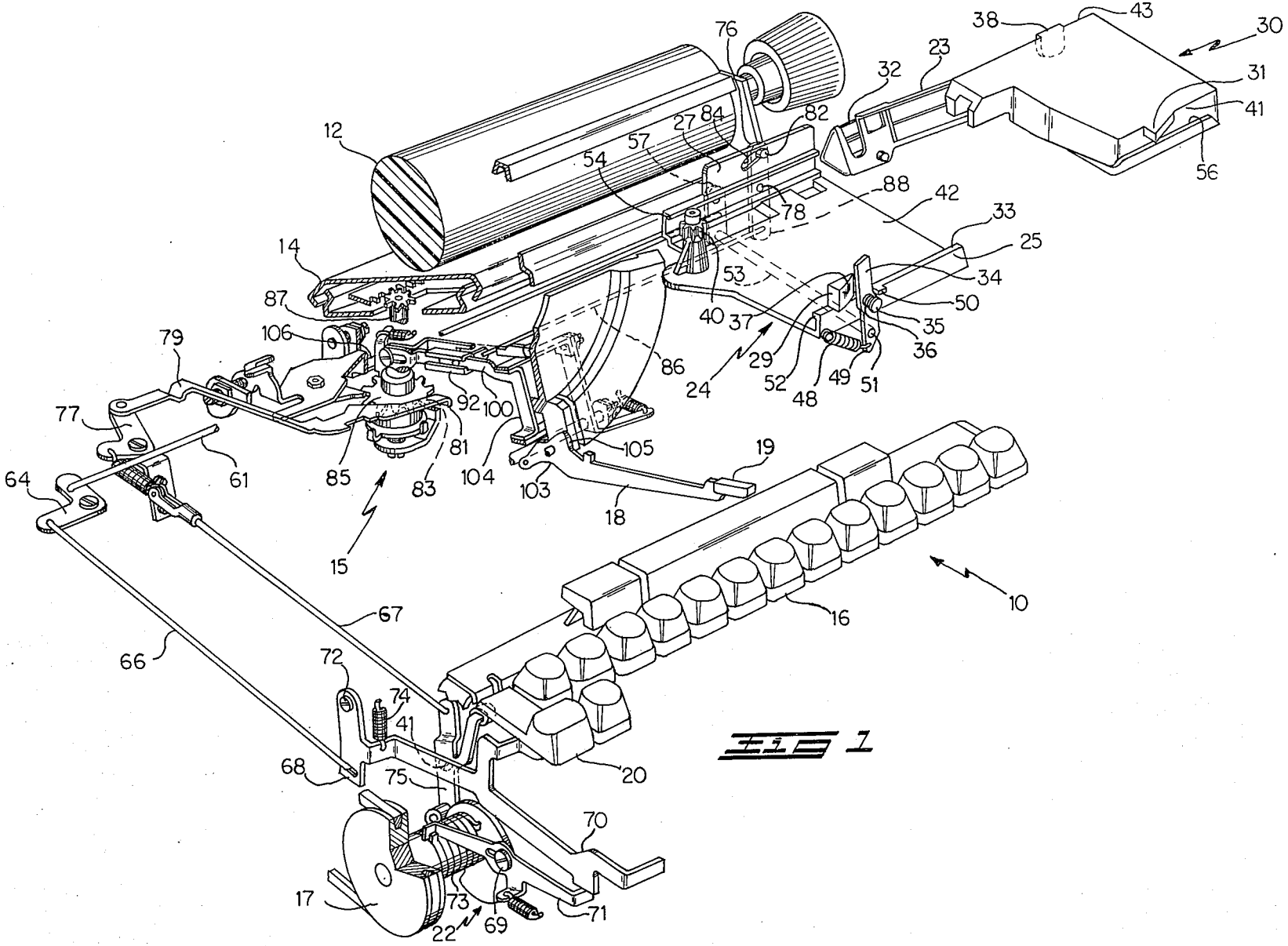
FIG. 1 is a perspective view of portions of a typewriter incorporating the invention.

The illustrated embodiment of FIG. 1 shows a typewriter 10 including a traversable printing platen 12 that is supported on an incrementally movable carriage 14, the movement of which is controlled by an escapement mechanism 15. This type of mechanism is fully disclosed in U.S. Pat. No. 2,649,179 entitled CARRIAGE FEEDING ESCAPEMENT MECHANISM and has the same assignee as the instant application. The typewriter also includes a plurality of character keys 16 for actuating typebars 18, only one of which is shown. Some function keys presently found in typewriters include carriage return, shift, margin release and backspacing. For clarity of illustration, only one function key 20 has been shown, specifically for actuating the backspace mechanism 22.

A ribbon cartridge platform 24 is fixed within typewriter 10, preferably in a horizontal plane. Ribbon cartridge platform 24 supports and guides a ribbon cartridge during insertion into and removal from typewriter 10. Ribbon cartridge platform 24 further includes a feed means 40 that is engageable by a ribbon cartridge to feed ribbon along an arm 23. The structure of ribbon cartridge platform 24 includes a flat base 42 having a pair of integral walls 25 and 27 extending upwards therefrom. Walls 25 and 27 are parallel to and spaced from one another to provide precise guiding for the insertion of a ribbon cartridge. Walls 25 and 27 include opposed overhanging retaining shelves 52 and 54, which overlie cooperating ledges 56 and 58 of the ribbon cartridge to prevent upward movement of the cartridge when inserted into ribbon cartridge platform 24.

A cartridge 30 suitable for proper actuating of the selected function includes an abutment 31 on a wall 41. Abutment 31 projects from an upper portion of ribbon cartridge wall 41 and is disposed in the path of a lever 34 as error correction ribbon cartridge 30 is inserted into typewriter 10. An integral upstanding camming abutment 29 is disposed on a top edge 33 of wall 25. As shown in FIG. 1, abutment 29 is positioned adjacent lever 34 as lever 34 is disposed in its actuable mode to be discussed below. Therefore, as error correction ribbon cartridge 30 is inserted into the typewriter 10, abutment 29 abuts and urges lever 34 progressively along a camming surface 37 of abutment 29. As lever 34 moves along abutment surface 37, it is displaced outwardly of wall 25 until it is displaced beyond the uppermost portion of abutment 29, at which time lever 34 is urged to return to its actuable mode.

Ribbon cartridge 30 may further include a second abutment 38 which projects from an upper portion of ribbon cartridge wall 43 and is disposed in the path of an actuating pin 82 when ribbon cartridge 30 is inserted into the typewriter 10.

The invention as embodied to the automatic backspacing mechanism, most clearly show in FIGS. 1, 5, 6, and 7 includes a lever 34 that is pivotally supported on a wall 25 of ribbon cartridge platform 24. Lever 34 is yieldable along the length of its pivot pin 35 and restrained from unnecessary yielding by a spring 36. This structure permits lever 34 to move against spring 36 outwardly on the extended pivot pin 35. Lever 34 is pivotal in a counterclockwise direction and retained in an actuable mode by a spring 48 that biases lever 34 against a stop 50. Rigidly fixed to a lower extension 49 of lever 34 in an end 51 of a rod 53 that extends under transverse ribbon cartridge platform 24. Another end 55 of rod 53 is rigidly fixed to a pivotal arm 57. Arm 57 is pivotally supported about a pivot 59 on a wall 27 of ribbon cartridge platform 24. Connected to arm 57 intermediate pivot 59 and rod end 55 is a link 61. Link 61 couples the above-described actuating mechanism to the backspace mechanism 22 by way of bellcrank 64 and link 66. Link 66 is connected to an extension 68 of a backspace lever 70. Therefore, lever 70, which is pivotally supported about a pivot 72 and biased to its inoperative mode by a spring 74, may be rendered operative by depressing backspace key 20 or by inserting error correction ribbon cartridge 30 to actuate the backspace mechanism. A backspace function occurs when backspace key 20 is depressed and an actuator bellcrank 71 is urged to pivot clockwise. A spring clutch 73 is thereby actuated to couple backspace mechanism 22 with a power source 17. A bellcrank 75 pivots clockwise and pulls link 67 frontward, which in turn pivots a bellcrank 77 counterclockwise about a pin 65. Bellcrank 77 drives a backspace link 79 toward the left which causes a tab 81 to engage a tooth 83 of a starwheel 85. Starwheel 85 rotates clockwise about a shaft 87 thereby backspacing carriage 14 one letter space.

Figure 2:
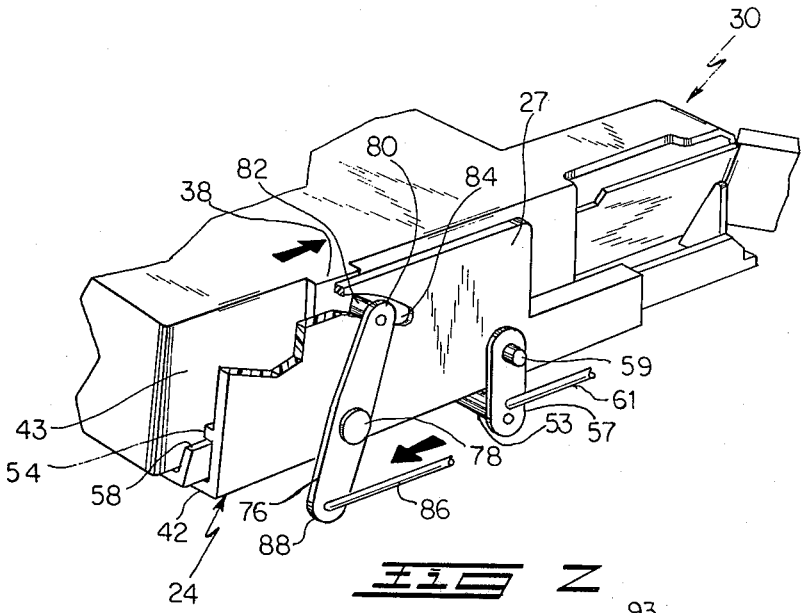
FIG. 2 is an enlarged perspective view of a portion of the error correction ribbon cartridge showing the actuating mechanism for disabling the escapement being actuated upon insertion of the ribbon cartridge.

The automatic escapement disabling mechanism incorporating the invention most clearly shown in FIGS. 1 and 2, includes a lever 76 that is pivotally supported on wall 27 of ribbon cartridge platform 24. Lever 76 is pivotal about a pivot 78 in a counterclockwise direction as viewed in FIG. 1. Upper end 80 of lever 76 carries fixed pin 82 which projects through an arcuate slot 84 in wall 27. A link 86 pivotally attached to a lower end 88 of lever 76 connects lever 76 with an escapement disabling bracket 90 at its upstanding flange 91, best shown in FIGS. 3 and 4. Bracket 90 is of flexible material and is fixed to a guide rail extension 92 of a typebar universal arm 93 at its base 94. A locking pin 96 is fixed in bracket 90 adjacent upstanding flange 91 and projects through an aligned aperture 98 of rail extension 92.

Figure 3:
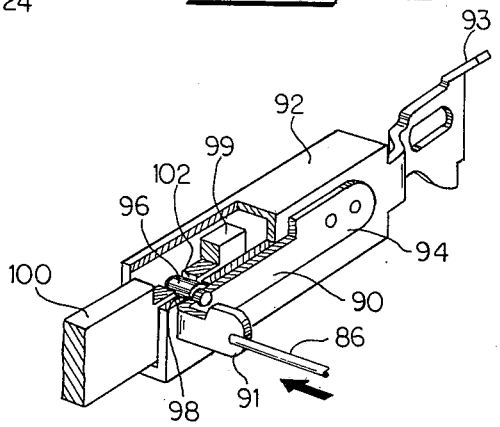
FIG. 3 is a perspective view of a potion of the escapement disabling mechanism in its inoperative mode.

In slideable cooperation with guide rail extension 92 is a second typebar universal arm 100. An end 99 of arm 100 includes an aperture 102 through which locking pin 96 projects when the escapement disabling means is in its inoperative mode as shown in FIG. 3. Arm 100 is an integral part of typebar universal 104 which is actuated during each typebar actuation.

In order to more fully appreciate the significance of the present invention as it relates to the escapement mechanism, an understanding of the operation of the escapement mechanism during a typical typing operation is suggested. During a typical typing operation, a key 16 is depressed which actuates a corresponding typebar 18. The base 103 of typebar 18 includes a camming surface 105 which, upon movement of typebar 18 bears against typebar universal 104 to urge typebar universal 104 rearwardly and carries with it integral universal arm 100. At this time, the escapement disabling mechanism is inoperative and locking pin 96 projects into aperture 98 of universal arm 93 thereby coupling universal arm 100 and universal arm 93 so as to act in a unitary fashion. As universal arm 93 moves rearward, it contacts an escapement trip arm 106 which actuates the escapement mechanism 15 as fully described in the aforementioned patent.

The present invention substantially automates typewriter functions and, as applied to the error correction procedure, overcomes the undesirable multiple backspace operations that are required to correct an erroneously typed character. During normal practice when an operator types an erroneous character on a typewriter containing both the automated backspace function and escapement disabling mechanism of the present invention, the following sequence of operations are required to correct the error. The operator must first remove printing ribbon cartridge from the typewriter. Then the operator inserts error correction ribbon cartridge 30 into the typewriter. Backspace mechanism 22 is automatically actuated in the following manner. As error correction ribbon cartridge 30 is inserted into typewriter 10 and slid along ribbon cartridge platform 24, abutment 31 engages lever 34 as shown in FIG. 5 and urges lever 34 to overcome the biasing effect of spring 48 and pivot counterclockwise, as viewed in FIG. 6. As lever 34 pivots counterclockwise, it rotates arm 57 through coupling rod 53 to thereby pull link 61 rightward, and by way of bellcrank 54, pulls link 66 rearward. The rearward movement of link 66 as shown in FIG. 1 overcomes the biasing effect of spring 74 and causes backspace lever 70 to pivot and urge backspace actuator bellcrank 71 to pivot clockwise about its mounting pivot 69 and actuate the backspace mechanism 22.

Figure 6:
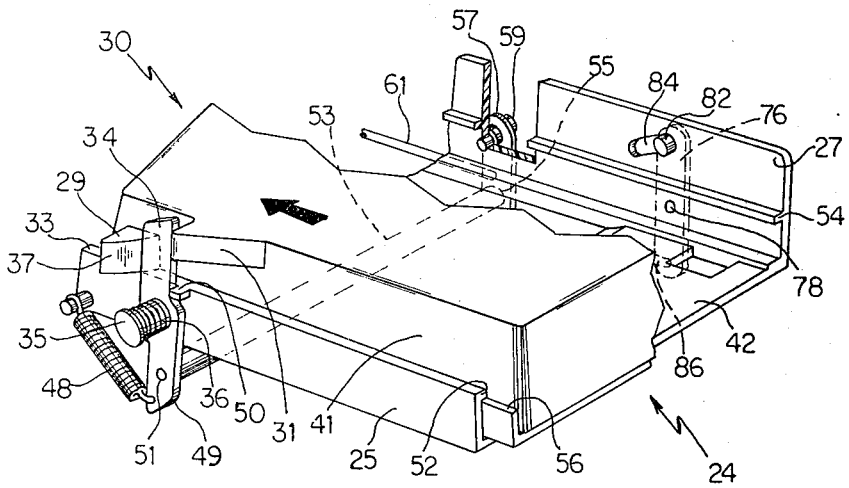
FIG. 6 is a view as shown in FIG. 5 showing the backspace actuating mechanism being actuated by the ribbon catridge.
Figure 6:
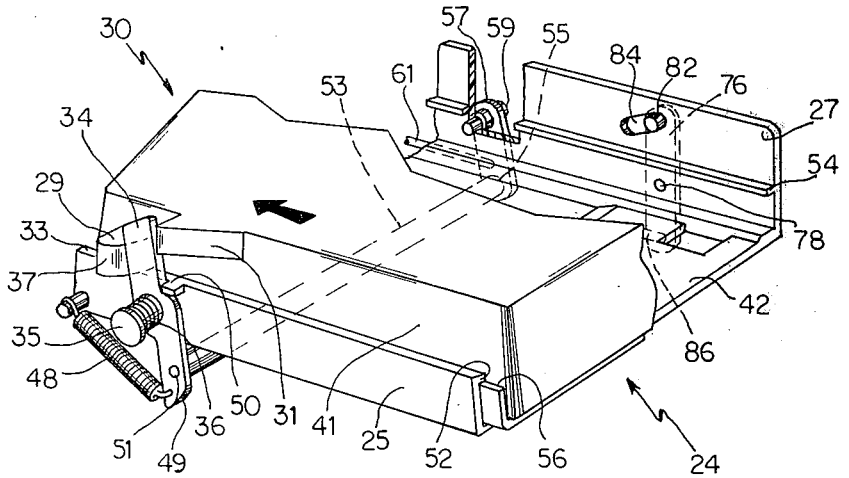
Figure 7:
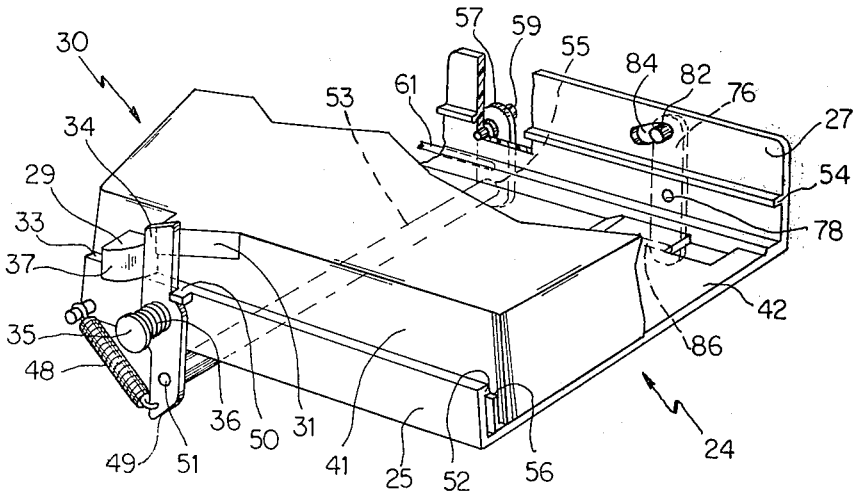
FIG. 7 is a view as shown in FIG. 6 showing the backspace actuating mechanism in its inoperative position.

Simultaneously, the upper portion of lever 34 is urged to progressively slide along camming surface 37 of abutment 29 and is displaced outwardly as shown in FIG. 6. Outward displacement of lever 34 is accomplished as lever 34 compresses spring 36 as it moves along the length of pivot 35. As lever 34 slides outwardly upon camming surface 37 beyond the highest point of abutment 31, spring 48 urges lever 34 to pivot clockwise and return to its actuable mode as shown in FIG. 7.

Figure 4:
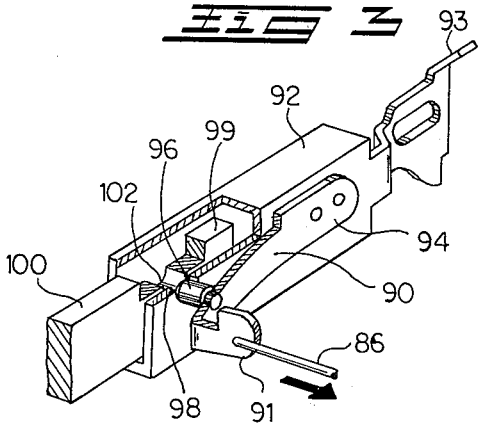
FIG. 4 is a view as in FIG. 3 with the escapement disabling mechanism in its operative mode.

At the time that the backspace mechanism 22 is actuated, a second abutment 38 on an opposite ribbon cartridge wall 43, as shown in FIG. 2, abuts pin 82 that projects through platform wall 27. Pin 82 is urged to pivot clockwise as shown in FIG. 2 and lever 76 pulls link 86 leftward. When link 86 is pulled, as shown in FIG. 4, flexible bracket 90 is pulled away from its contiguous relationship with guide rail extension 92 carrying with it locking pin 96 thereby removing it from aperture 102 of typebar universal arm 100. As a result, typebar universal arm 100 is slideable within guide rail extension 92 of typebar universal arm 93. Therefore, the two universal amrs are no longer unitary but independent. As long as pin 96 remains disengaged from aperture 102, typebar universal arm 100 is slidable within guide rail extension 92, thereby disabling or preventing escapement operation and needless backspacing during typebar actuation. Carriage 14 will remain stationary until locking pin 96 is re-inserted into aperture 102 thereby rendering typebar universal arm 100 and typebar universal arm 93 unitary.

With the error correction cartridge 30 inserted, carriage 14 has been backspaced and the escapement disabled so that upon typebar overstrike, the erroneous character is rendered semiinvisible. Error correction ribbon cartridge 30 is then removed from typewriter 10. when error correction ribbon cartridge 30 is removed, lever 76 is free to return to its actuable mode, as shown in FIG. 1, and the escapement mechanism is again operational. The operational mode of escapement mechanism 15 occurs when lever 76 returns to its actuable mode and releases link 86. Link 86 moves leftward and bracket 90 returns to its contiguous relationship with guide rail extension 92. Locking pin 96 is thereby re-inserted into aperture 102. Therefore, typebar universal arm 100 and typebar universal arm 93 are again unitary and function as a single arm. Consequently, when a typing function is actuated, typebar universal 104 is actuated, which actuates escapement mechanism 15.

A printing ribbon cartridge is then re-inserted into typewriter 10 and the correct character is typed over the correction material previously deposited on writing paper. Normal typing is now continued.

It is clear from the above that where a typewriter is adapted with response means for actuating a selected typewriter function, the use thereof requires only the step of inserting a suitable cartridge therein.

The procedure of removing a printing ribbon cartridge, installing error correction ribbon cartridge 30, overstriking the erroneously typed character, removing error correction ribbon cartridge 30 and re-inserting the printing ribbon cartridge and typing the correct character is greatly simplified and automated compared to typewriters not containing the automated backspacing mechanism.

Although the foregoing embodiment has illustrated the use of two independent typewriter functions to co-act and fully automate the correction operation, it is clear that they can be singly automated and used independently.

Although the cooperating cartridge abutment 31 and the typewriter responsive lever 34 have been illustrated in vertical orientation and specifically positioned, it is clear that they may readily assume other locations and orientations provided that they lie in a common path. In addition, it should be borne in mind that the term "abutment" is not intended to be restrictively defined and can include any cartridge surface whether projecting or otherwise.

While the foregoing description has shown and described the fundamental novel features as applied to a preferred embodiment, it will be understood by those skilled in the art that modifications embodied in various forms may be made without departing from the spirit and scope of the invention.

What is claimed is:

1. In a typewriter which includes operational means for said typewriter to perform at least one typewriter function for causing the alignment of a selected platen impact point relative to the typewriter print point and having means for receiving a ribbon cartridge comprising:

means disposed in the typewriter and engageable by the cartridge for actuating said operational means upon insertion of the cartridge into the typewriter to thereby perform at least a selected one of said functions.

2. In a typewriter as defined in claim 1 wherein said receiving means includes a platform fixed in the typewriter for supporting and guiding the cartridge into the typewriter.

3. In a typewriter as defined in claim 1 wherein said actuating means includes means responsive to contact with said cartridge for actuating the function when the cartridge is being inserted into the typewriter.

4. In a typewriter as defined in claim 3 wherein said responsive means includes a lever pivotally carried by said typewriter in the path of travel of the cartridge when the cartridge is being inserted into the typewriter.

5. In a typewriter as defined in claim 2 wherein said typewriter further includes a function mechanism and said actuating means includes means on said receiving platform responsive to said cartridge for actuating the function mechanism when the cartridge is being inserted into the typewriter.

6. In a typewriter as defined in claim 5 wherein said responsive means includes a lever pivotally disposed on a wall of the cartridge platform and in the path of travel of the cartridge for engaging the cartridge upon insertion into the typewriter.

7. In a typewriter as defined in claim 6 wherein said responsive means further includes linkage means operatively connected to the function mechanism for transmitting motion from said lever to the function mechanism.

8. In a typewriter as defined in claim 7 wherein said actuating means further includes a camming means disposed below the path of travel of the ribbon cartridge proximate said lever for disengaging said lever from said actuating means after the typewriter function has been actuated.

9. In a typewriter as defined in claim 2 wherein said actuating means further includes means on said receiving platform responsive to contact with a surface on said cartridge for actuating a function mechanism upon the insertion of a cartridge.

10. The typewriter according to claim 9 wherein said means on said platform is an a lever.

11. In a typewriter having operational means to perform a carriage backspacing function and means for receiving a ribbon cartridge, comprising:

means disposed in the typewriter and engageable by the ribbon cartridge for actuating said operational means upon insertion of the ribbon cartridge into the typewriter to thereby perform the backspace function.

12. In a typewriter as defined in claim 11 wherein said receiving means includes a platform fixed in the typewriter for supporting and guiding the ribbon cartridge into the typewriter.

13. In a typewriter as defined in claim 12 wherein said actuating means further includes means on said receiving platform responsive to contact with said cartridge for actuating said operational means when the ribbon cartridge is being inserted into the typewriter.

14. In a typewriter as defined in claim 13 wherein said responsive means includes a lever pivotally disposed on a wall of the ribbon cartridge platform and in the path of travel of the ribbon cartridge for engaging the ribbon cartridge when being inserted into the typewriter.

15. In a typewriter as defined in claim 14 wherein said responsive means further includes linkage means operatively connected to the backspace mechanism for transmitting motion from said lever to the backspace mechanism.

16. In a typewriter as defined in claim 14 wherein said actuating means further includes a camming means disposed outside the path of travel of the ribbon cartridge proximate said lever for disengaging said lever from said cartridge after the backspace function has been actuated.

17. In a typewriter of the type which receives an insertable and removable ribbon cartridge and is provided with a backspacing mechanism, the improvement comprising:

means carried by the typewriter for operationally activating the backspace mechanism; and co-acting means carried by the ribbon cartridge for actuating said activating means of the typewriter to initiate the backspace mechanism upon insertion of the ribbon cartridge.

18. In a typewriter as defined in claim 17 wherein said activating means includes a lever pivotally disposed in the path of the ribbon cartridge and said coacting means includes an abutment disposed on the ribbon cartridge for engaging said lever when the ribbon cartridge is inserted into the typewriter.

19. In a typewriter as defined in claim 18 wherein said activating means further includes linkage means operatively connected to the backspace mechanism for transmitting motion from said lever to the backspace mechanism.

20. An automatic backspacing mechanism for typewriters that utilize ribbon cartridges, the typewriter having an incrementally forward traversable printing platen for supporting a printing medium, a plurality of typebars for impacting on the printing medium during traversing, a plurality of corresponding keys for actuating the typebars and other typewriter instrumentalities, a backspace mechanism responsive to another key for incrementally reversing the forward traverse of the printing platen, a ribbon cartridge platform fixed in the typewriter for supporting and guiding the ribbon cartridge into the typewriter to position a ribbon at a printing station in front of the printing medium whereby the key actuated typebars impact thereon to transfer character images through the ribbon of the ribbon cartridge to the print medium, wherein the improvement comprises in combination:

means on the ribbon cartridge for actuating the backspacing mechanism; and means on the ribbon cartridge platform responsive to the ribbon cartridge actuating means for actuating the backspace mechanism when the ribbon cartridge is inserted into the typewriter.

21. An automatic backspacing mechanism as defined in claim 20 wherein said actuating means includes an abutment on a wall of the ribbon cartridge and said responsive means includes a lever that is pivotally supported on a wall of the ribbon cartridge platform and engageable by said abutment for pivotal movement relative to said platform wall.

22. In a typewriter of the type having an incrementally traversable carriage, the movement of which is controlled by an escapement mechanism and means for receiving a ribbon cartridge comprising:

means disposed in the typewriter, and engageable by the ribbon cartridge for disabling the escapement mechanism upon insertion of the ribbon cartridge.

23. In a typewriter as defined in claim 22 wherein said receiving means includes a platform fixed in the typewriter for supporting and guiding the ribbon cartridge into the typewriter.

24. In a typewriter as defined in claim 23 wherein said disabling means further includes means on said receiving platform responsive to the insertion into the typewriter of a ribbon cartridge.

25. In a typewriter as defined in claim 23 wherein said disabling means includes an abutment disposed on a wall of the ribbon cartridge and further includes means on said receiving platform responsive to said abutment for disabling the escapement mechanism when the ribbon cartridge is inserted into the typewriter.

26. In a typewriter as defined in claim 24 wherein said responsive means includes a lever pivotally disposed on a wall of the ribbon cartridge platform and in the path of travel of the ribbon cartridge.

27. In a typewriter as defined in claim 24 wherein said responsive means further includes linkage means operatively connected to the escapement mechanism for transmitting motion from said lever to the escapement mechanism.

28. In a typewriter having a backspacing mechanism for an incrementally traversable carriage, controlled by an escapement mechanism, and means for receiving a ribbon cartridge comprising:

means disposed in the typewriter and engageable by the ribbon cartridge for actuating the backspace mechanism upon insertion of the ribbon cartridge into the typewriter; and means disposed in the typewriter and engageable by the ribbon cartridge for disabling the escapement mechanism upon insertion of the ribbon cartridge.

29. In a typewriter as defined in claim 28 wherein said receiving means includes a platform fixed in the typewriter for supporting and guiding the ribbon cartridge in the typewriter.

30. In a typewriter as defined in claim 29 wherein said actuating means includes an abutment disposed on a wall of the ribbon cartridge and further includes means on said receiving platform responsive to said abutment for actuating the backspace mechanism when the ribbon cartridge is being inserted into the typewriter.

31. In a typewriter as defined in claim 30 wherein said responsive means includes a lever pivotally disposed on a wall of the ribbon cartridge platform and in the path of travel of the ribbon cartridge for engaging said abutment when the ribbon cartridge is being inserted into the typewriter.

32. In a typewriter as defined in claim 28 wherein said disabling means includes an abutment disposed on a wall of the ribbon cartridge and further includes means on said receiving platform responsive to said abutment for disabling the escapement mechanism.

33. In a typewriter as defined in claim 32 wherein said responsive means includes a lever pivotally disposed on a wall of the ribbon cartridge platform and in the path of travel of the ribbon cartridge for engaging said abutment when the ribbon cartridge is being inserted into the typewriter.

34. A method for actuating a functional operation for causing the alignment of a selected platen impact point relative to the typewriter print point of a typewriter mechanism, independent of function key which comprises: inserting a ribbon cartridge into a typewriter to ffect said functional operation.

35. A method for controlling the operation of a typewriter mechanism, which comprises:

moving a surface of a typewriter ribbon cartridge against a structure in the typewriter for effecting a function for causing the alignment of a selected platen impact point relative to the typewriter print point of the typewriter mechanism independent of a function key.

36. A method for automatically acutating the backspace mechanism of a typewriter, independent of a backspace actuating key which comprises:

inserting a ribbon cartridge into a typewriter; and thereby actuating the backspace mechanism 37. A method for automatically disabling the escapement mechanism of a typewriter mechanism, which comprises:

inserting a ribbon cartridge into a typwriter and thereby disabling the escapement mechanism upon insertion of said ribbon cartridge.

* * * * *